US008789892B2

(12) United States Patent
Niederriter et al.

(10) Patent No.: US 8,789,892 B2
(45) Date of Patent: Jul. 29, 2014

(54) DRIVE MECHANISM FOR A LONGWALL MINING MACHINE

(75) Inventors: Edward F. Niederriter, Fryburg, PA (US); Shawn W. Franklin, Emlenton, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 271 days.

(21) Appl. No.: 13/282,038

(22) Filed: Oct. 26, 2011

(65) Prior Publication Data

US 2012/0104832 A1 May 3, 2012

Related U.S. Application Data

(60) Provisional application No. 61/408,281, filed on Oct. 29, 2010.

(51) Int. Cl.
*E21C 29/02* (2006.01)
*E21C 35/12* (2006.01)

(52) U.S. Cl.
CPC *E21C 29/02* (2013.01); *E21C 35/12* (2013.01)
USPC ..... 299/43

(58) Field of Classification Search
USPC ..... 299/42, 43; 74/842
See application file for complete search history.

(56) References Cited

U.S. PATENT DOCUMENTS

| | | | | |
|---|---|---|---|---|
| 2,281,503 A | | 4/1942 | Levin | |
| 2,283,461 A | | 5/1942 | Pray | |
| 3,954,299 A | | 5/1976 | Hartley | |
| 4,025,120 A | * | 5/1977 | Balinov et al. | 299/43 |
| 4,067,620 A | | 1/1978 | Lanfermann | |
| 4,082,361 A | | 4/1978 | Lanfermann | |
| 4,183,585 A | * | 1/1980 | Brennan | 299/43 |
| 4,236,758 A | | 12/1980 | Groger | |
| 4,269,304 A | | 5/1981 | Braun et al. | |
| 4,396,229 A | | 8/1983 | Stoppani | |
| 4,435,018 A | | 3/1984 | Parrott | |
| 4,453,774 A | | 6/1984 | Knorr | |
| 4,515,409 A | | 5/1985 | Parrott | |
| 4,819,989 A | * | 4/1989 | Kleine | 299/43 |
| 4,896,920 A | * | 1/1990 | Weber et al. | 299/42 |
| 4,943,120 A | | 7/1990 | Groger | |

(Continued)

FOREIGN PATENT DOCUMENTS

| | | | |
|---|---|---|---|
| GB | 1600282 | | 10/1981 |
| GB | 2144788 A1 | * | 3/1985 |

(Continued)

*Primary Examiner* — David Bagnell
*Assistant Examiner* — Michael Goodwin
(74) *Attorney, Agent, or Firm* — Michael Best & Friedrich LLP

(57) ABSTRACT

A mining machine for mining along a mining face includes a longwall shearer, a product removal system for removing product cut by the longwall shearer, and a drive system for moving the longwall shearer along a rack extending along the mining face. The drive system including a housing coupled to the longwall shearer, a motor, and a sprocket at least partially positioned within the housing and drivingly connected to the motor. The sprocket is engaged with the rack and moves the longwall shearer along the rack. A shoe maintains the sprocket in engagement with the rack. The housing is configured to rotate relative to the longwall shearer such that the drive system adjusts for vertical height variations and horizontal variations of the rack.

25 Claims, 9 Drawing Sheets

(56) References Cited

U.S. PATENT DOCUMENTS

| | | | | |
|---|---|---|---|---|
| 4,993,779 | A | 2/1991 | Cocksedge | |
| 4,998,777 | A | 3/1991 | Schetina et al. | |
| 5,092,659 | A | 3/1992 | Grathoff | |
| 5,704,267 | A | 1/1998 | Merten et al. | |
| 6,267,449 | B1 * | 7/2001 | Meya et al. | 299/43 |
| 7,731,298 | B2 * | 6/2010 | Merten et al. | 299/34.11 |

FOREIGN PATENT DOCUMENTS

| | | |
|---|---|---|
| GB | 2330123 | 4/1999 |
| RU | 2004795 | 12/1993 |
| SU | 1263843 A1 * | 10/1986 |

* cited by examiner

DRIVE MECHANISM FOR A LONGWALL MINING MACHINE

CROSS-REFERENCE TO RELATED APPLICATIONS

This application claims priority to U.S. Provisional Application No. 61/408,281, filed on Oct. 29, 2010, the entire contents of which are incorporated herein by reference in their entirety.

BACKGROUND

The present invention relates to drive arrangements for continuous face underground mining. In particular, the invention relates to sprocket drives for an armoured face conveyor (AFC) rack system used with longwall shearers.

Traditional longwall shearers utilize a two-sprocket drive that moves the shearer along a mining face, and an example of such a drive is shown in U.S. Pat. No. 7,731,298. Generally, two-sprocket drive systems include a first sprocket that is driven by a drive system such as a motor. A second sprocket intermeshes with the first sprocket and further intermeshes with a rack extending along a mining face. As the driven first sprocket is rotated, the second sprocket is forced to rotate, thereby pulling the shearer along the rack. The first sprocket rotates about a first axis and the second sprocket rotates about a second axis parallel to the first axis. The second sprocket is rotatable about the first sprocket such that the vertical distance between the first axis and the second axis is adjustable. In this way, the height of the shearer may be adjusted, as desired, to accommodate various mining faces.

Traditional two-sprocket drive arrangements provide for a wide range of height adjustability. However, in low-height conditions or thin mining seams (i.e., low seams) the two-sprocket arrangement does not provide a low enough profile while also providing a desired material removal rate. Further, in a two sprocket design, wear between the top and driven sprocket can be troublesome. Since the driven sprocket must float axially with the top sprocket fixed, tooth wear can create thrust loads that can damage haulage components.

SUMMARY OF THE INVENTION

In one construction, the invention provides a mining machine for mining along a mining face. The mining machine includes a longwall shearer, a product removal system for removing product cut by the longwall shearer, and a drive system for moving the longwall shearer along a rack extending along the mining face. The drive system includes a housing coupled to the longwall shearer, a motor, and a sprocket at least partially positioned within the housing and drivingly connected to the motor. The sprocket is engaged with the rack and moves the longwall shearer along the rack. A shoe maintains the sprocket in engagement with the rack. The housing is configured to rotate relative to the longwall shearer such that the drive system adjusts for vertical height variations and horizontal variations of the rack.

In another construction, the invention provides a mining machine for mining a mining face of material. The mining machine is movable along an armoured face conveyor that includes a rack. The mining machine includes a body that defines a first side facing toward the mining face and a second side facing away from the mining face, a cutter head that is mounted to the body for cutting into the mining face, a prime mover, and a drive system that moves the mining machine along the rack. The drive system includes one-and-only-one sprocket that is driven by the prime mover and engages the rack to move the mining machine along the mining face.

In another construction, the invention provides a drive assembly for a mining machine for mining along a mining face. The mining machine defines a face-side toward the mining face and a gob-side away from the mining face and includes a longwall shearer, a product removal system for removing product cut by the longwall shearer, a rack extending along the mining face, and a prime mover positioned within the longwall shearer. The drive assembly includes one-and-only-one sprocket coupled to the prime mover by a drive shaft and driven by the prime mover to move the mining machine along the mining face. The drive assembly further includes a sprocket housing that is coupled to the longwall shearer and includes a shoe that selectively engages the rack to maintain the rack in engagement with the sprocket. The sprocket is disposed within the sprocket housing. The shoe includes a face-side member that engages a bottom surface of the rack, a spacer member, and a gob-side member that engages a gob-side of the rack. The drive shaft defines a longitudinal axis and the sprocket is movable along the longitudinal axis on the drive shaft. Further, the sprocket housing rotates relative to the longwall shearer about the longitudinal axis and in a face-to-gob direction.

Other aspects of the invention will become apparent by consideration of the detailed description and accompanying drawings.

Figure 1:
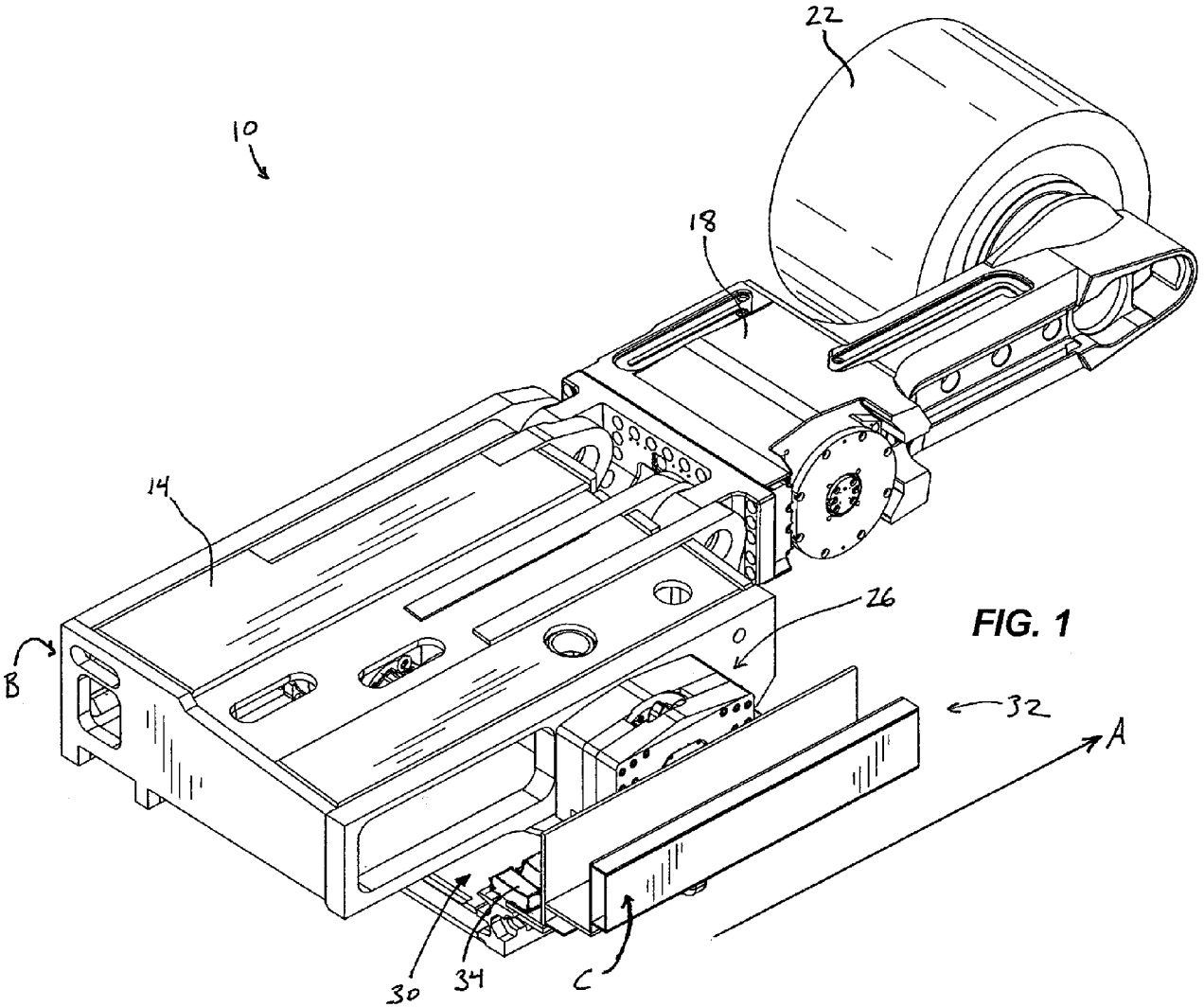
FIG. 1 is a perspective view of a mining machine according to one construction of the invention.
Figure 2:
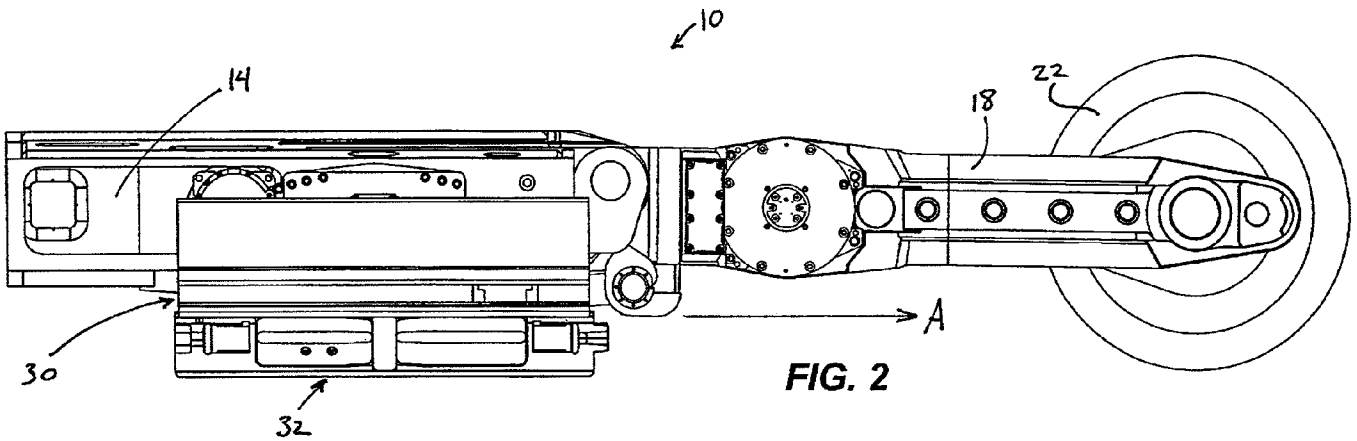
FIG. 2 is a side view of the mining machine of FIG. 1 from a gob-side of the machine.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

FIGS. 1-4 illustrate a mining machine, which is a longwall shearer 10, according to one construction of the invention. The shearer 10 includes a frame or body portion 14, a front or first cutter arm 18 pivotably connected to the body portion 14, and a front or first cutter head 22 rotatably coupled to the front cutter arm 18. The shearer 10 also includes a drive system 26 and a product removal system 30. Although not illustrated, in other constructions, the shearer 10 includes a rear or second cutter arm pivotably connected to the body portion 14 opposite the front cutter arm 18, a rear or second cutter head rotatably coupled to the second cutter arm, and second drive system is mounted to the body portion 14 near the second cutter arm. In other words, a double ended mining machine may have a cutting arm and head at a front end and at a back end (i.e., first and second ends) and two drive systems, one located at each end. Only one cutter arm and drive assembly will be described below, but it is understood that mining machines can make use of more than one drive system, as desired.

The longwall shearer 10 is moved along a mining face by the drive system 26 to cut into the mining face. Typically, such longwall shearers 10 are used for mining coal. As the face is cut by the front cutter head 22, the material falls onto the product removal system 30, which is a conveyor in the illustrated construction, and is conveyed away from the face to shuttle cars or another removal solution (e.g., train, carts, a separate conveyor, etc.). The shearer 10 defines a direction of travel A along which the drive system 26 moves the shearer 10, a first or face-side B facing toward the mining face, and a second or gob-side C facing away from the mining face (i.e., opposite the face-side).

Figure 4:
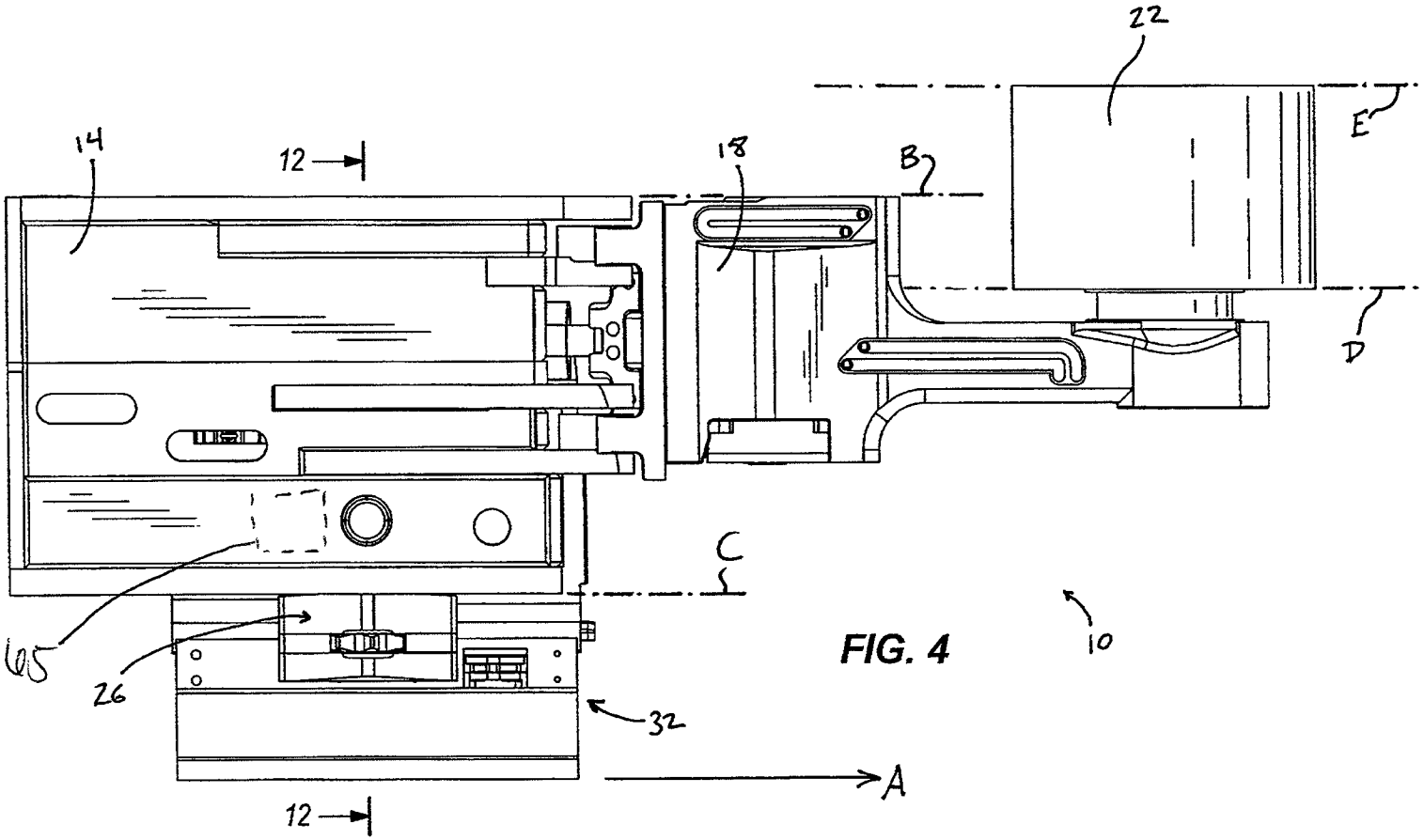
FIG. 4 is a top view of the mining machine of FIG. 1.
Figure 5:
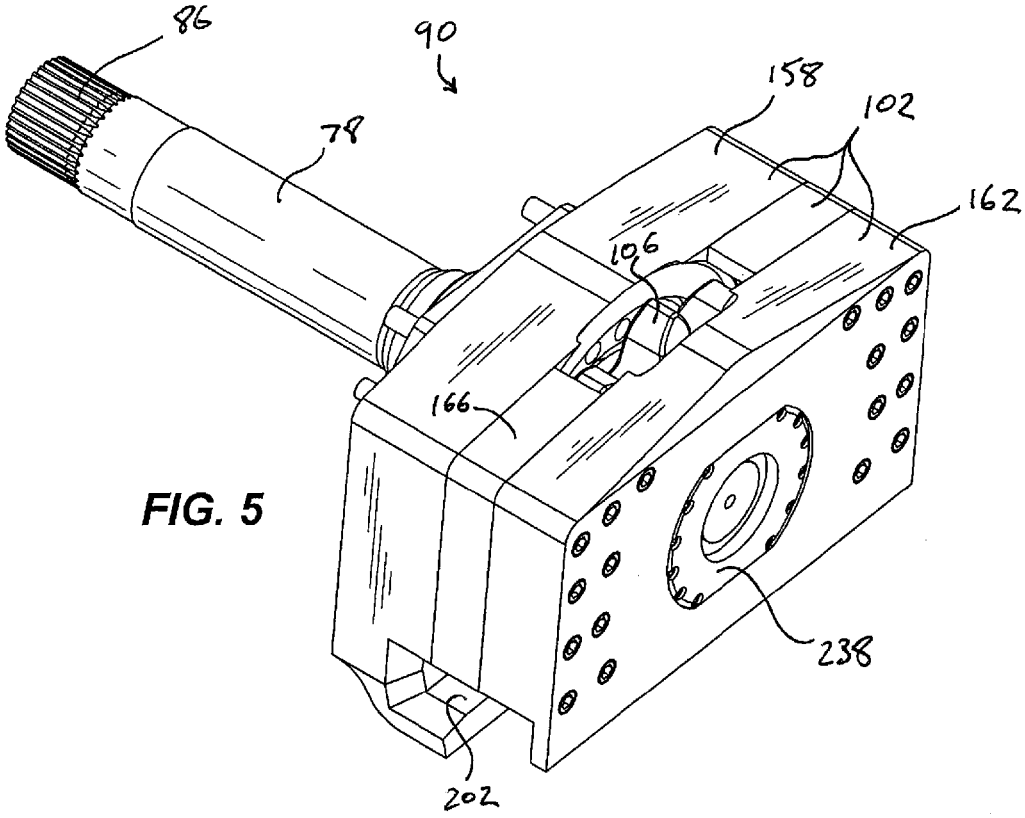
FIG. 5 is a top perspective view of a drive assembly for the mining machine of FIG. 1.
Figure 6:
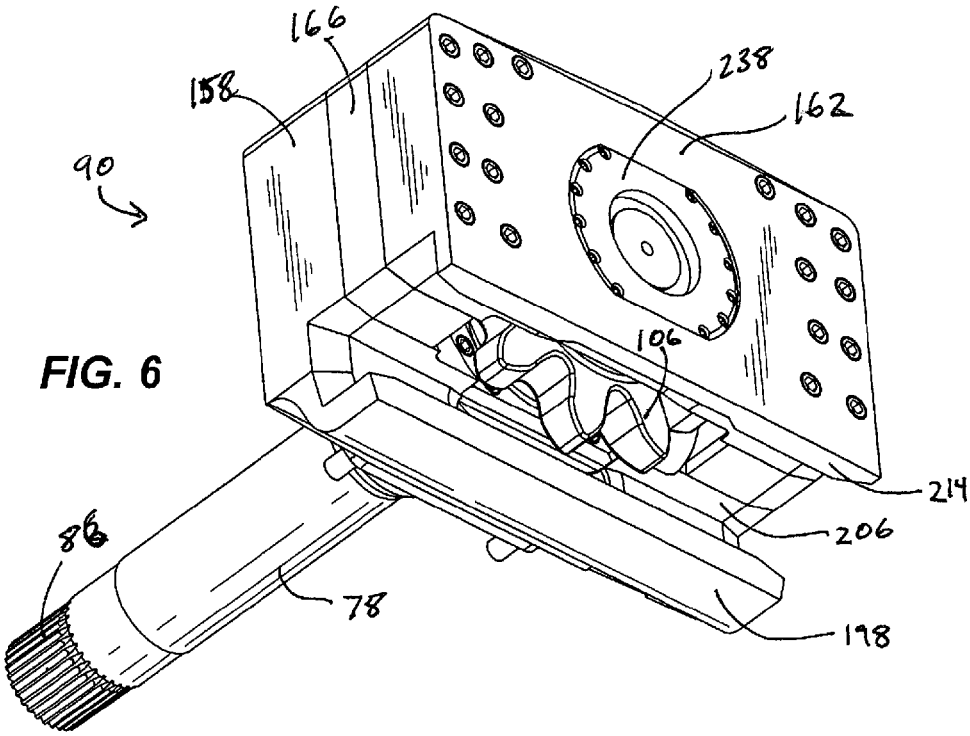
FIG. 6 is bottom perspective view of the drive assembly of FIG. 5.
Figure 7:
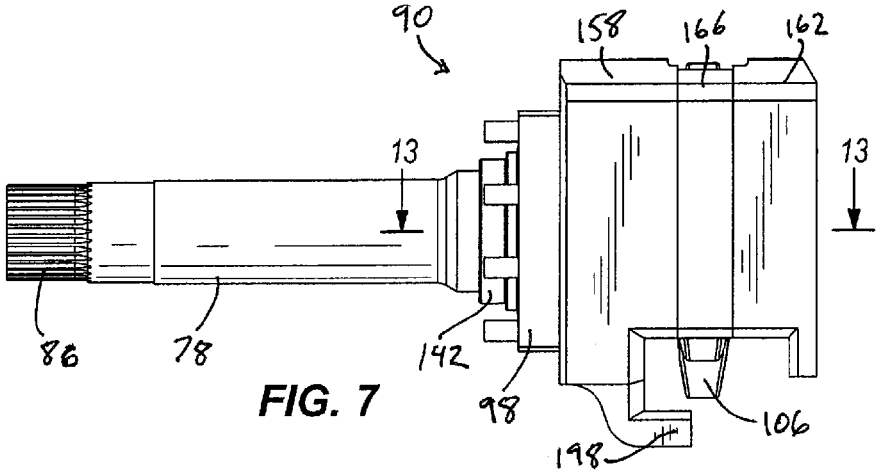
FIG. 7 is a front view of the drive assembly of FIG. 5.
Figure 8:
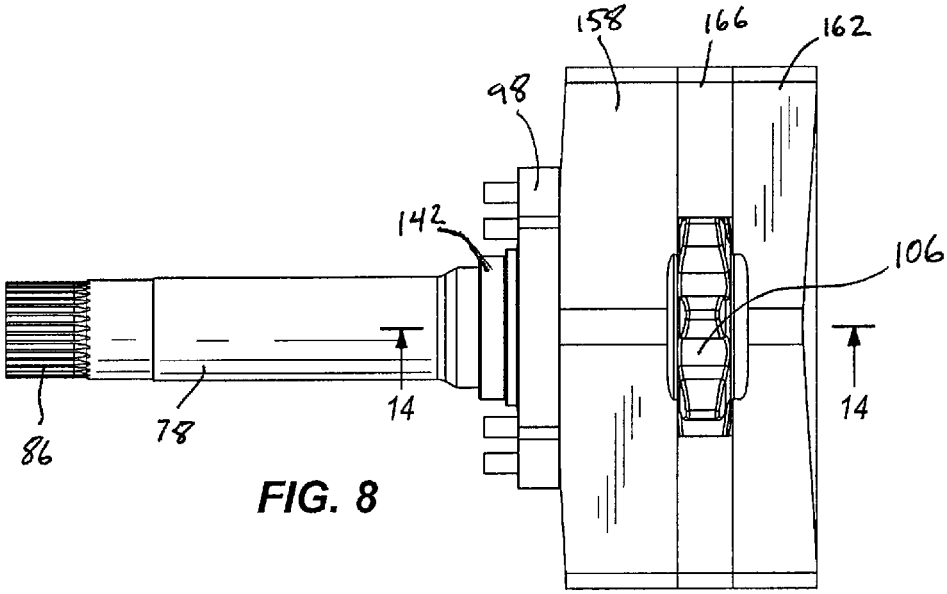
FIG. 8 is a top view of the drive assembly of FIG. 5.
Figure 9:
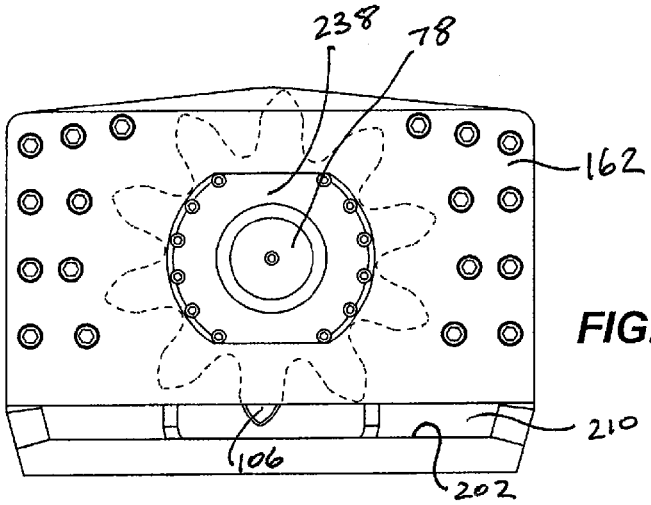
FIG. 9 is a side view of the drive assembly of FIG. 5 from the gob-side of the machine.

FIG. 4 illustrates a top view of the longwall shearer 10. The gob-side of the front cutter head 22 defines a cutter gob-side-plane D, and the face-side of the cutter head 22 defines a cutter face-side-plane E. The face-side B of the body portion 14 extends beyond the cutter gob-side-plane D toward the mining face, but does not extend past the cutter face-side-plane E. This arrangement is referred to as an in-web arrangement. In other words, the body 14 of the shearer 10 is in-web of the cutter head 22 and does not extend beyond the face-side-plane E of the cutter head 22. The in-web portion of the body 14 is the portion that extends beyond the cutter gob-side-plane D toward the mining face.

Figure 3:
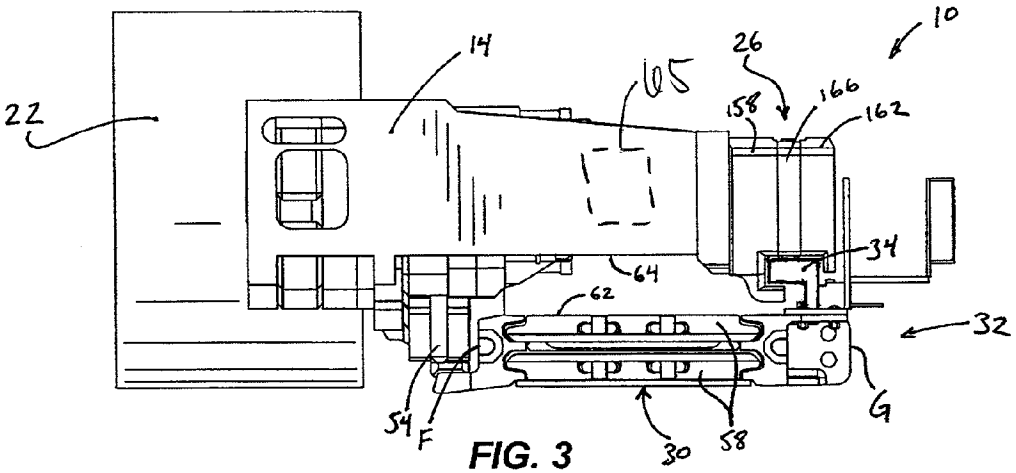
FIG. 3 is a front view of the mining machine of FIG. 1.
Figure 14:
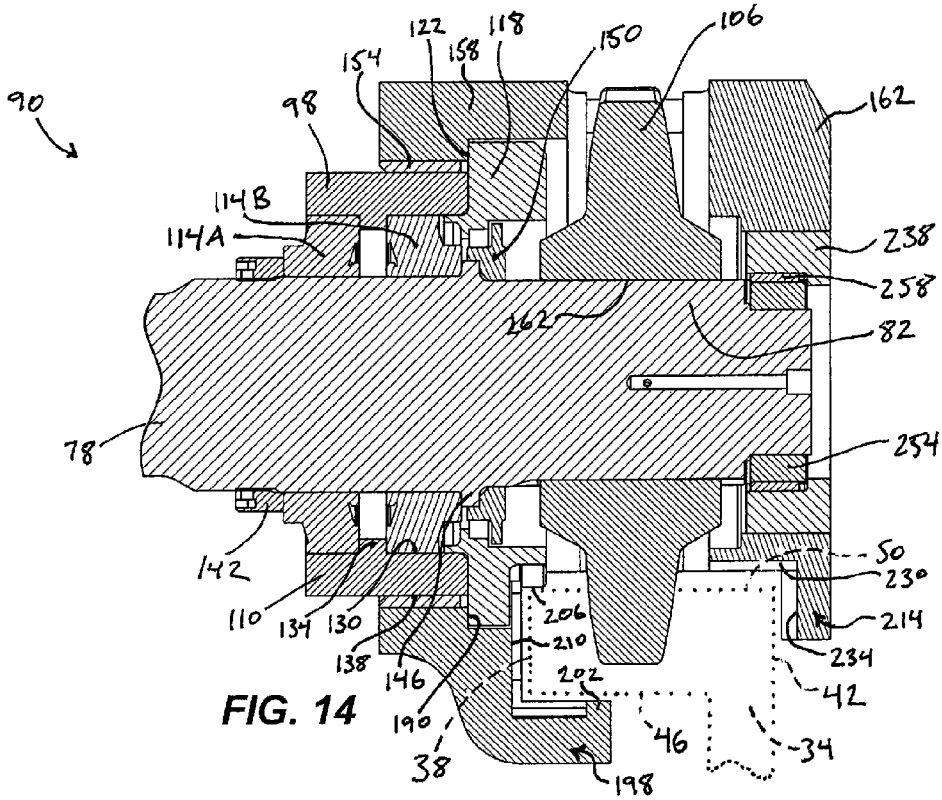
FIG. 14 is a section view of the drive assembly taken along line 14-14 in FIG. 8.

With reference to FIG. 3, a support structure 32 in the form of an armoured face conveyor is positioned beneath the longwall shearer 10 to support the shearer for movement along the mining face and includes the product removal system 30 and a rack 34. The support structure 32 defines a face-side F and a gob-side G. The rack 34 is an elongated gear or chain that extends along the mining face on the gob-side G of the support structure 32, as best seen in FIG. 1. In other arrangements, the rack 34 may be positioned differently, as desired (e.g., toward the face-side F). The rack 34 includes a plurality of teeth (e.g., gear teeth, chain links). With reference to FIG. 14, the rack 34 defines a face-side surface 38, a gob-side surface 42, a bottom surface 46, a top surface 50, and a length that extends along the mining face in the direction of travel. Referring to FIG. 3, a guide member 54 is positioned adjacent the face-side F of the support structure 32 to maintain the shearer 10 in alignment with the rack 34.

Figure 12:
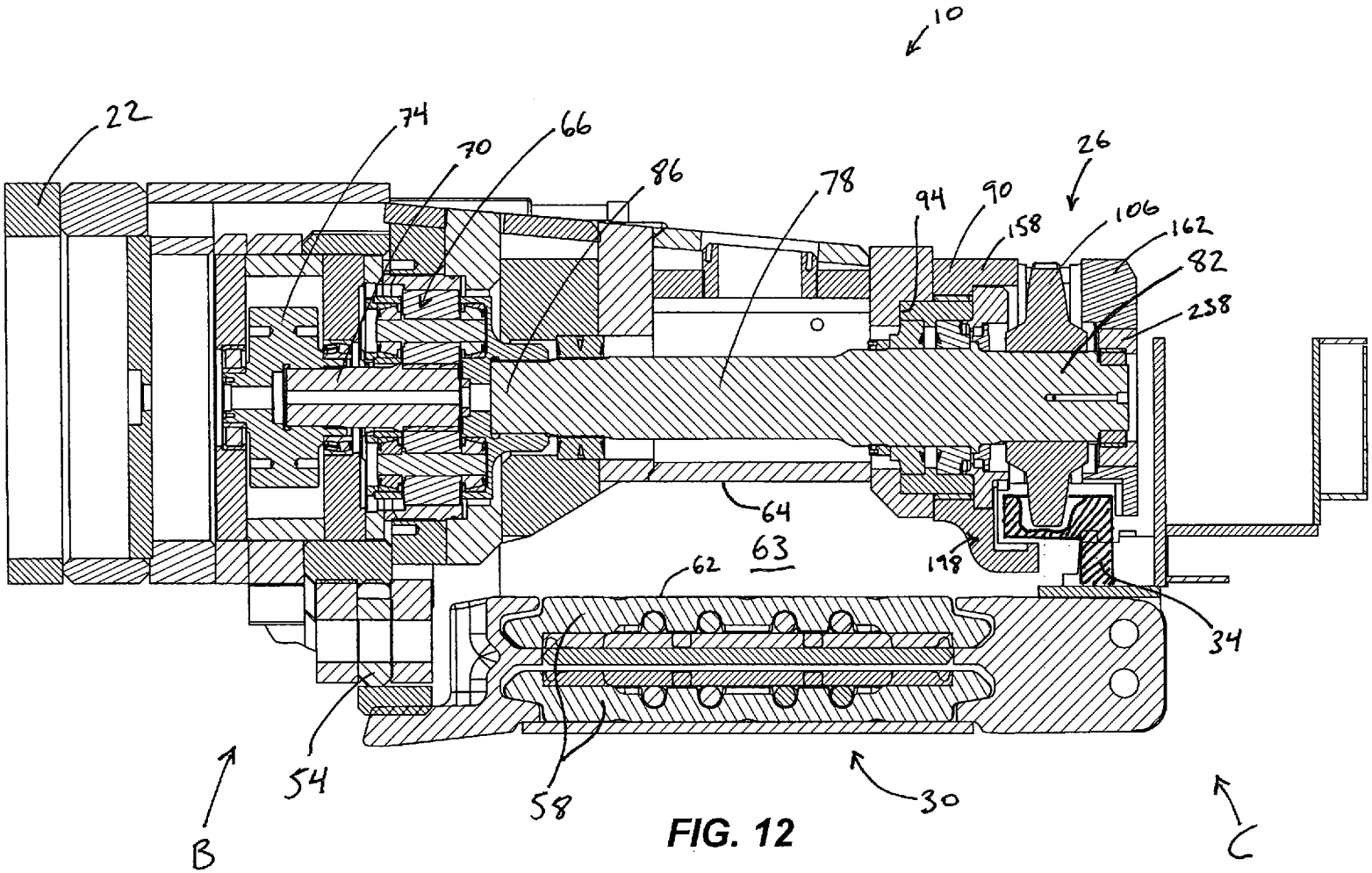
FIG. 12 is a section view of the mining machine taken along line 12-12 in FIG. 4.

Turning to FIGS. 3 and 12, the illustrated product removal system 30 includes a conveyor 58 supported on the support structure 32 and positioned beneath the body 14 of the longwall shearer 10. The conveyor 58 collects material cut from the mining face and conveys it, including beneath the body 14 of the longwall shearer 10, to a desired location. The conveyor 58 includes a continuous belt or chain that wraps around the support structure 32 and is driven to convey material. The conveyor 58 defines a top surface 62 that engages material to be conveyed. Further, a tunnel 63 is defined between the top surface 62 of the conveyor and a bottom surface 64 of the longwall shearer body 14. The in-web arrangement of the shearer allows positioning of a motor (not shown) to drive the cutter head 22 and other components out of the tunnel 63 cross-section so as not to obstruct material flow.

Referring to FIG. 12, a drive system 26 includes a prime mover 65 (best shown in FIGS. 3 and 4) positioned within the body 14 of the longwall shearer 10 and coupled to a planetary gear set 66 via a splined input shaft 70. In the illustrated construction, the prime mover 65 is a drive system motor that is separate from the motor used to drive the shearer cutter head 22. In other constructions, the prime mover 65 is the same motor used to rotate the shearer cutter head 22. The input shaft 70 is driven by a gear 74 coupled to the prime mover 65 by a chain (not shown). In other constructions, the prime mover 65 may be directly coupled to the input shaft 70. The planetary gear set 66 couples the input shaft 70 to a drive shaft 78 and produces a desired gear ratio between rotation of the input shaft 70 and rotation of the drive shaft 78. The illustrated planetary gear set 66 is positioned within the face-side B of the shearer 10. The drive shaft 78 extends from the planetary gear set 66 to the gob-side C of the shearer 10 and includes a first splined portion 82 on the gob-side of the drive shaft 78. Further, the drive shaft 78 is coupled to the planetary gear set 66 via a second splined portion 86. In other constructions, the planetary gear set 66 may be another gear or transmission type.

In typical longwall shearers, the planetary gear set is positioned in a center of the longwall shearer body directly above the conveyor. Shifting the position of the planetary gear set 66 away from the center of the shearer body 14 allows the shearer body 14 to be lowered toward the conveyor 58 and the bottom surface 64 of the shearer body 14 to be raised. This arrangement allows the overall height of the shearer 10 to be lower while maintaining a tunnel 63 between the top surface 62 of the conveyor 58 and the bottom surface 64 of the shearer body 14 that is large enough to move the desired amount of material therethrough.

Figure 13:
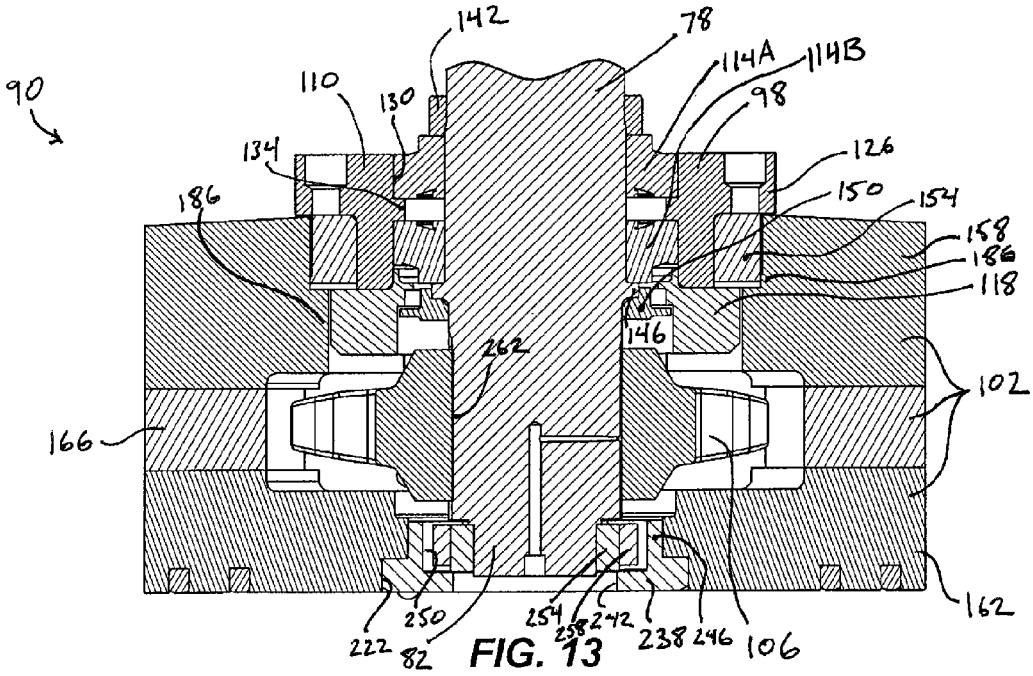
FIG. 13 is a section view of the drive assembly taken along line 13-13 in FIG. 7.

A drive sprocket assembly 90 is coupled (e.g., fastened) to a mounting surface 94 (FIG. 12) formed on the gob-side C of the shearer body 14. Referring to FIGS. 13 and 14, the drive sprocket assembly 90 includes a bearing carrier 98 that is fixedly coupled to the mounting surface 94, a sprocket housing 102 coupled to the bearing carrier 98, and a drive sprocket 106 positioned within the sprocket housing 102. The sprocket 106 is mounted to the splined portion 82 of the drive shaft 78 to engage with and travel along the rack 34. The sprocket housing 102 is axially rotatable relative to the bearing carrier 98 such that the drive sprocket assembly 90 may adjust to minor vertical or pitch variations of the rack 34 while moving the shearer 10 along the rack 34.

The bearing carrier 98 includes a carrier housing 110, a bearing 114, and a coupling ring 118 coupled to the carrier housing 110. The ring 118 includes a retaining surface 122 (FIG. 14) formed on a face-side of the ring 118. The carrier housing 110 includes a flange 126 (FIG. 13) that abuts the mounting surface 94 of the shearer body 14 when the drive sprocket assembly 90 is installed on the shearer 10. The carrier housing 110 defines a bearing support surface 130 on an inner periphery, an annular projection 134 on the bearing support surface 130, and a housing support surface 138 on an outer periphery. In the illustrated construction, the flange 126 includes fasteners that project through the flange 126 and are received in corresponding apertures formed in the mounting surface 94 when the drive sprocket assembly 90 is installed on the shearer 10.

The bearing 114 includes two bearing members that couple the drive shaft 78 to the drive sprocket assembly 90 such that the drive shaft 78 rotates relative to the bearing carrier 98 and the sprocket housing 102. The annular projection 134 is positioned between the two bearing members, and the first bearing member 114A is held in place with a bearing retainer 142 (which is threaded onto the shaft 78 in the illustrated construction), while the second bearing member 114B is sandwiched between the annular projection 134 and a projection 146 formed on the drive shaft 78. In the illustrated construction, the first and second bearing members 114A, 114B are roller bearings designed to handle radial, moment, and thrust loads. In other constructions, the bearing members may be different, as desired, to provide a rotational coupling between the drive shaft 78 and the drive sprocket assembly 90. A seal carrier 150 with seal (not shown) is coupled to the drive shaft 78 (e.g., via press fit) to retain oil in the gear case and inhibit material from accessing the bearing carrier 98.

Figure 10:
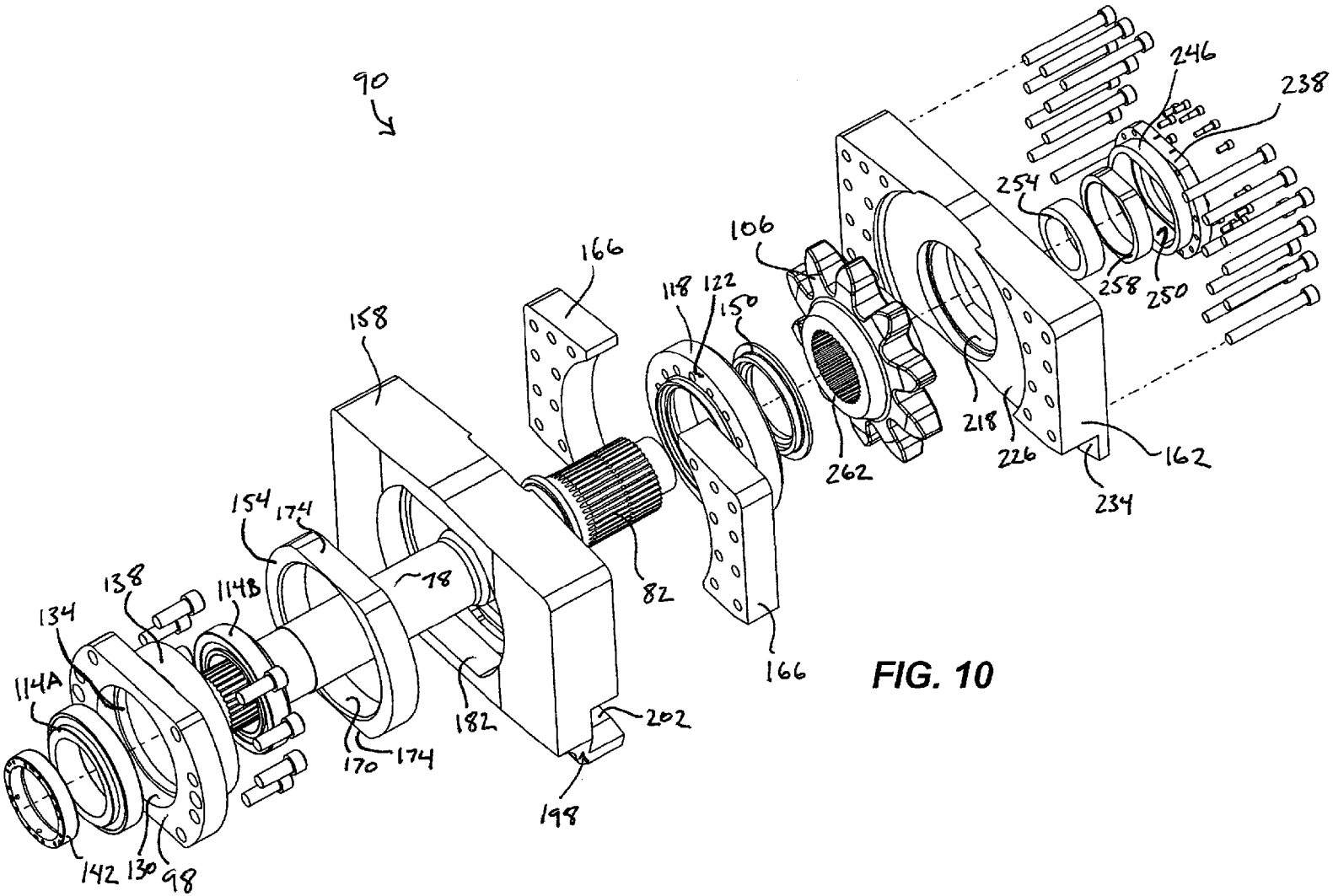
FIG. 10 is a top, face-side exploded view of the drive assembly of FIG. 5.
Figure 11:
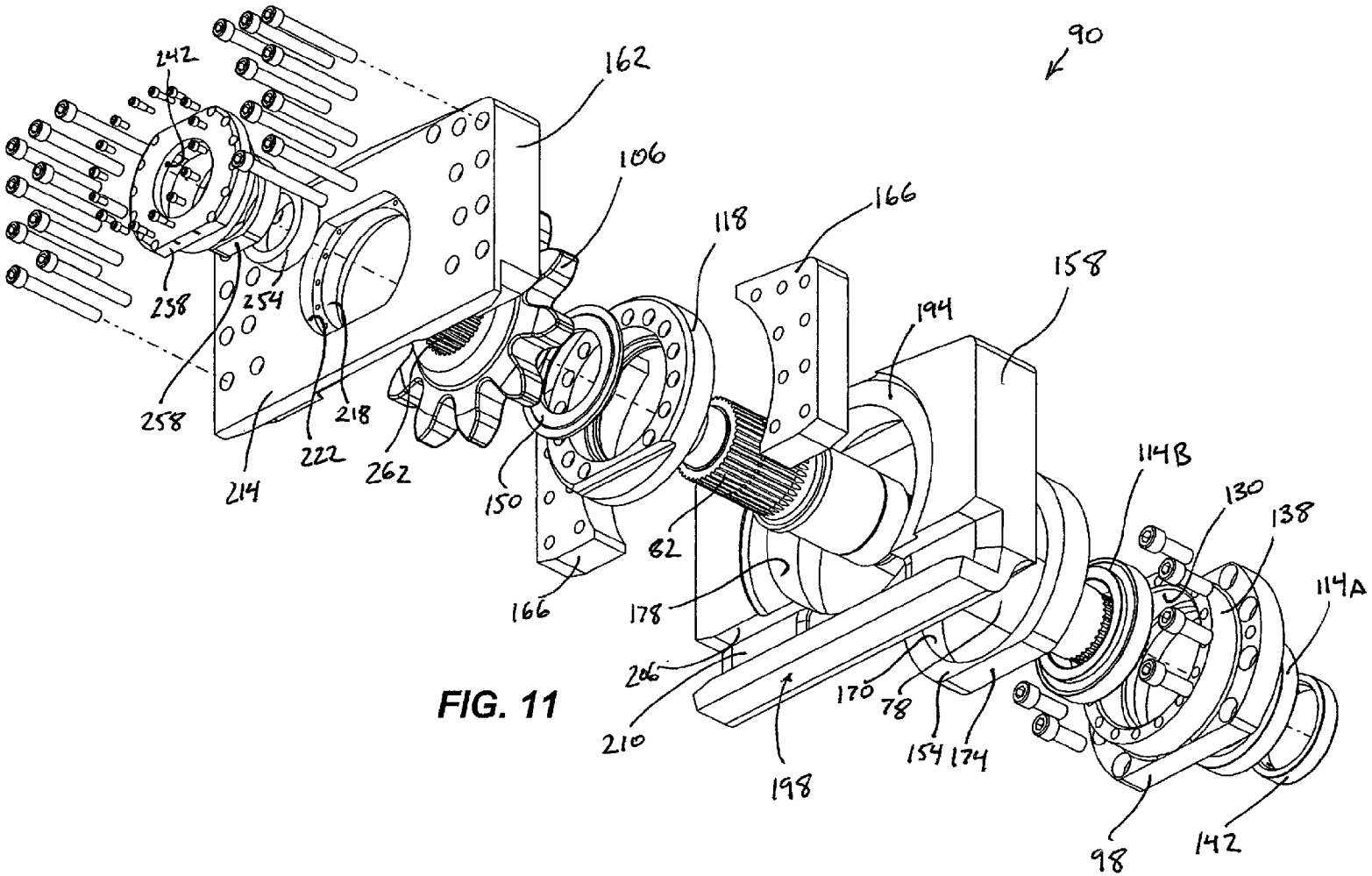
FIG. 11 is a bottom, gob-side exploded view of the drive assembly of FIG. 5.

The sprocket housing 102 includes a first bushing 154 coupled to the housing support surface 138 of the carrier housing 110, a face-side member 158 in which the first bushing 154 is seated and held to the bearing carrier 98 by the coupling ring 118, a gob-side member 162, and a spacer member 166 positioned between the face-side member 158 and the gob-side member 162. With reference to FIGS. 10 and 11, the first bushing 154 includes an annular inner periphery 170 that mates with and is rotatable relative to the housing support surface 138 of the carrier housing 110, and two flat portions 174 formed on an outer periphery. The first bushing 154 is held in place between the flange 126 of the carrier housing 110 and the coupling ring 118 and is formed of steel. In other constructions, the first bushing 154 may be formed of another material, as desired.

The face-side member 158 includes an aperture 178 through which the drive shaft 78 passes. A bushing recess 182 is formed into a face-side of the face-side member 158 and shaped to receive the first bushing 154 therein such that the first bushing 154 does not rotate relative to the face-side member 158. The bushing recess 182 is also formed to interact with the coupling ring 118. The bushing recess 182 is formed such that the coupling ring 118 does not engage side portions 186 (FIG. 13) of the face-side member 158 along, which allows the sprocket housing 102 to rotate relative to the bearing carrier 98 in a horizontal plane. The bushing recess 182 is configured such that the coupling ring 118 engages the face-side member 158 adjacent flat portions 190 (FIG. 14) of the bushing recess 182 corresponding to the flat portions 174 of the first bushing 154, which maintains the sprocket housing 102 coupled to the bearing carrier 98 (FIG. 14). This arrangement allows the sprocket housing 102 to rotate slightly in the horizontal plane to adjust to minor horizontal variations in the path of the rack 34 as the drive sprocket assembly 90 moves the longwall shearer 10 along the rack 34. In other words, the axial and radial clearances between the first bushing 154 and the adjacent features of the sprocket housing 102 allow the sprocket housing 102 to move relative to the body portion 14 of the shearer 10. Further, a sprocket recess 194 (FIG. 11) is formed in the face-side member 158 to provide space for the sprocket 106 within the sprocket housing 102.

The face-side member 158 also includes a trapping shoe portion 198, which is defined by a groove formed in a gob-side face of the member 158, for engaging the rack 34. The trapping shoe portion 198 defines a lower lip 202 that engages the bottom surface 46 of the rack 34, an upper lip 206 that engages the top surface 50 of the rack 34, and a side surface 210 that engages the face-side surface 38 of the rack 34. The lower lip 202, the upper lip 206, and the side surface 110 move in and out of contact with the rack 34; however, the lips 202, 206 and the side surface 110 maintain the rack 34 in engagement with the sprocket 106 during variations in the rack 34 path along the length of the rack 34.

Referring to FIGS. 10 and 11, the gob-side member 162 includes a shoe portion 214, and defines an aperture 218, a cap recess 222 (FIG. 11) formed about the aperture 218 from the gob-side of the gob-side member 162, and a sprocket recess 226 (FIG. 10) formed in the face-side of the gob-side member 162. The shoe portion 214 of the gob-side member 162 includes an upper lip 230 (FIG. 14) that selectively engages the top surface 50 of the rack 34 and a side surface 234 that selectively engages the gob-side member 162 of the rack 34. The sprocket recess 226 provides room for the sprocket 106 within the sprocket housing 102.

The cap recess 222 is generally circular and includes two flat portions. A cap 238 is seated in the cap recess 222 and includes a periphery that compliments the shape of the cap recess 222, a central aperture 242, and an extended sidewall 246 that axially extends into the aperture 218 of the gob-side member 162. A generally circular shaft recess 250 is formed in the cap 238 from the face-side and includes two flat portions.

A rigid bushing 254 is coupled to a gob-side end of the drive shaft 78 (e.g., via press-fit). A second bushing 258 is fit about the rigid bushing 254 and is seated within the shaft recess 250 of the cap 238. The second bushing 258 includes two flat portions that correspond to the flat portions formed in the cap recess 222. The second bushing 258 cooperates with the first bushing 154 to allow the sprocket housing 102 to pivot or rotate in the horizontal plane with respect to the bearing carrier 98. In another construction, the rigid bushing 254 is replaced with a roller bearing.

In the illustrated construction, the spacer member 166 includes two spacer plates, each of the plates sandwiched between and coupled to the face-side member 158 and the gob-side member 162. The spacer member 166 provides enough room within the sprocket housing 102 for the sprocket 106 to operate as desired. In other constructions, the spacer member 166 may be formed as a part of the face-side member 158, the gob-side member 162, or have a different shape.

The sprocket 106 includes a splined aperture 262 that receives the first splined portion 82 of the drive shaft 78, and a plurality of teeth that engage the teeth of the rack 34. The first splined portion 82 of the drive shaft 78 is wider than the sprocket 106 and the sprocket 106 is allowed to slide axially on the splined portion 82 to further adjust for horizontal variations in the path of the rack 34 and rack/sprocket wear. As the drive shaft 78 rotates, the sprocket 106 is rotated and pulls the longwall shearer 10 along the rack 34 to continuously cut the mining face with the cutter head 22.

The illustrated sprocket housing 102 rotates (i.e., pivots, articulates) about the longitudinal axis of the drive shaft 78 in order to accommodate or adapt to peaks and valleys (i.e., vertical height variations) of the rack 34 along the mining face. This arrangement allows the trapping features (e.g., the trapping shoe portion 198 of the face-side member 158 and the shoe portion 214 of the gob-side member 162) to be integrated into the sprocket housing 102. The sprocket housing 102 also adapts to the rack 34 snaking by articulating horizontally (i.e., in the face-to-gob plane). Such articulation reduces wear of the trapping features and the rack 34.

The uni-sprocket drive assembly 90 offers a mining machine that lowers cost per ton of mined product in mines with a low seam height and reduces the amount of rock cut by the mining machine leading to less reject material cut from the face. The shearer 10 can mine at a height of about 1.3 meters, which is not possible with current longwall methods, shearers or plows. The longwall shearer machine 10 can cut as low as 1.3 meters and still achieve 10,000 tons per day production. In order to fit the support structure (i.e., armoured face conveyor) and shearer into such a low profile envelope, some constraints are set for the illustrated construction. A minimum of 300 mm tunnel 63 height was specified in order for the required passage of material under the machine to reach the target production. The shearer body 14 height from the ground should not exceed 900 mm in order to provide ample clearance between the top of the shearer body 14 and the underside of a roof support canopy. With this constraint and as discussed above, a typical shearer two-sprocket downdrive is an obstacle in getting the desired low profile.

Shifting the planetary gear set 66 to the face-side B of the shearer body 14 makes it possible to drop the planetary gear set 66/drive shaft 78/drive sprocket 106 combination lower with respect to the shearer body 14 in order to achieve a sprocket diameter below the 900 mm machine height constraint while positioning the sprocket 106 closer to the rack 34 to create more tunnel 63 height. In order to achieve the required tunnel 63 height, the height of the rack 34 must also be raised. Typically, rack 34 heights are lowered in order to achieve the lowest possible longwall shearer body 14 profile with a conventional, two-sprocket design. In the uni-sprocket drive assembly 90 it is desirable for the rack 34 height to be raised enough to meet the pitch diameter of the drive sprocket 106 on the shearer to achieve the 300 mm minimum tunnel 63 height.

In addition, the uni-sprocket drive assembly 90 eliminates the wear that typically exists between the two drive sprockets on a two-sprocket downdrive system. Further, the ability of the inventive system to accommodate snaking and other misalignment of the rack 34 reduces the wear on the sprocket 106.

The bearing carrier 98 transfers shaft forces into the shearer body 14. Additionally, the bolt-on arrangement (a) provides the ability to remove the uni-sprocket drive assembly 90 so that a conventional, two-sprocket downdrive arrangement can be used in its place in order to raise the machine 10, (b) allows the sprocket housing 102 (with integrated trapping shoe) to rotate about the drive shaft 78 axis to handle mining face undulations, and (c) provides the means in which the housing 102 can articulate in the face-to-gob plane to minimize wear between the trapping features and the rack 34. Further, the bolt-on design allows for easy assembly, disassembly, replacement, and maintenance.

In addition, other advantages are provided and various aspects and details of the invention provide these and other advantages. One skilled in the art will appreciate that variations of the above described features exist and may be implemented to achieve the desired advantages in other ways while still embodying the spirit of the invention.

Various features and advantages of the invention are set forth in the following claims.

What is claimed is:

1. A mining machine for mining along a mining face, the mining machine including a longwall shearer, a product removal system for removing product cut by the longwall shearer, and a drive system for moving the longwall shearer along a rack extending along the mining face, the drive system comprising:

a housing coupled to the longwall shearer;

a motor;

a sprocket at least partially positioned within the housing and drivingly connected to the motor, the sprocket engaged with the rack to move the longwall shearer along the rack;

a drive shaft coupling the sprocket and the motor, the drive shaft rotating the sprocket and defining a longitudinal axis; and a shoe for maintaining the sprocket in engagement with the rack, wherein the housing is configured to rotate relative to the longwall shearer such that the drive system adjusts for vertical height variations and horizontal variations of the rack, wherein the sprocket is axially movable along the longitudinal axis of the drive shaft while maintaining engagement with the rack.

2. The drive system of claim 1, wherein the sprocket is the only sprocket included in the housing.

3. The drive system of claim 1, wherein the sprocket is coupled directly to the motor via a planetary gear arrangement.

4. The drive system of claim 3, wherein the longwall shearer defines a first side facing the mining face and second side spaced away from the mining face, wherein the planetary gear is located adjacent the first side of the longwall shearer and spaced from the sprocket to provide a space under the housing.

5. The drive system of claim 4, wherein the sprocket is located adjacent the second side of the longwall shearer.

6. The drive system of claim 1, wherein the shoe forms at least a part of the housing.

7. The drive system of claim 1, wherein the shoe rotates about the longitudinal axis of the drive shaft while maintaining the sprocket in engagement with the rack.

8. The drive system of claim 1, wherein the sprocket includes a spline that receives a splined portion of the drive shaft.

9. The drive system of claim 1, wherein the longwall shearer includes a frame, the sprocket is coupled directly to the motor via a planetary gear arrangement, the motor and the planetary gear arrangement are positioned within the frame of the longwall shearer, and the housing is coupled to the frame while receiving the drive shaft into the sprocket.

10. The drive system of claim 9, wherein the housing includes a first side member that defines the shoe for engaging a bottom surface of the rack and an aperture about the drive shaft, and the housing further includes a second side member coupled to the first side member, and wherein the first side member is coupled to the frame via a coupling member.

11. The mining machine of claim 1, wherein the housing articulates in a face-to-gob direction.

12. The mining machine of claim 1, wherein the housing rotates about the longitudinal axis of the drive shaft.

13. A mining machine for mining a mining face of material, the mining machine movable along an armoured face conveyor that includes a rack, the mining machine comprising:

a body defining a first side facing toward the mining face and a second side facing away from the mining face, the body defining a body plane extending from the first side toward the second side;

a cutter head mounted to the body for cutting into the mining face;

a prime mover; and a drive system for moving the mining machine along the rack, the drive system including one-and-only-one sprocket at least partially positioned within a housing of the drive system and driven by the prime mover, the sprocket in engagement with the rack to move the mining machine along the mining face;

wherein the housing articulates in a direction parallel to the body plane.

14. The mining machine of claim 13, wherein the drive system includes a planetary gear arrangement positioned proximate the first side of the body and coupled between the prime mover and the sprocket to rotatably drive the sprocket.

15. The mining machine of claim 13, wherein the housing includes a shoe that selectively engages the rack to maintain the rack in engagement with the sprocket.

16. The mining machine of claim 15, wherein the housing further includes a bushing coupled to the shoe to allow the shoe to move relative to the body.

17. The mining machine of claim 13, wherein the housing rotates about a drive shaft coupled between the prime mover and the sprocket.

18. The mining machine of claim 13, wherein the housing is coupled to the body.

19. The mining machine of claim 13, wherein the housing includes a first member, a second member, and a spacer member positioned between the first and second members, and further wherein the sprocket is positioned between the first and second members.

20. The mining machine of claim 13, wherein the drive system further includes a bearing carrier coupled to the body, the bearing carrier having a bearing that rotatably couples a drive shaft between the prime mover and the sprocket, the housing rotatably coupled to the bearing carrier.

21. The mining machine of claim 13, wherein the drive system further includes a drive shaft coupled between the prime mover and the sprocket.

22. The mining machine of claim 21, wherein the drive shaft includes a splined portion, the sprocket coupled to the splined portion and operable to slide axially along the splined portion within the housing.

23. The mining machine of claim 13, wherein the cutter head defines a first side plane proximate the mining face and a second side plane opposite the first side plane, the body extending past the second side plane toward the mining face.

24. The mining machine of claim 13, wherein the sprocket is axially movable along a longitudinal axis of the drive shaft and is rotatable by the drive shaft.

25. A drive assembly for a mining machine for mining along a mining face, the mining machine defining a first side facing toward the mining face and a second side facing away from the mining face, the mining machine including a longwall shearer, a product removal system for removing product cut by the longwall shearer, a rack extending along the mining face, and a prime mover positioned within the longwall shearer, the drive assembly comprising:

one-and-only-one sprocket coupled to the prime mover by a drive shaft, the sprocket driven by the prime mover to move the mining machine along the mining face; and a housing coupled to the longwall shearer and including a shoe that selectively engages the rack to maintain the rack in engagement with the sprocket, the sprocket disposed within the housing, the shoe including a first member that engages a bottom surface of the rack, a spacer member, and a second member that engages a side of the rack;

wherein the drive shaft defines a longitudinal axis, the sprocket movable on the drive shaft along the longitudinal axis, and wherein the housing rotates relative to the longwall shearer about the longitudinal axis and in a face-to-gob direction.

* * * * *